US005813458A

United States Patent [19]

Smith, Jr. et al.

[11] Patent Number: 5,813,458

[45] Date of Patent: Sep. 29, 1998

[54] INDICATING DOG SUB FOR WEIGHT-SET PACKERS

[75] Inventors: Sidney K. Smith, Jr., Conroe; George Givens, Houston, both of Tex.

[73] Assignee: Baker Hughes Incorporated, Houston, Tex.

[21] Appl. No.: 789,369

[22] Filed: Jan. 24, 1997

[51] Int. Cl.[6] ..... E21B 33/128

[52] U.S. Cl. ..... 166/182; 166/187

[58] Field of Search ..... 166/182, 134, 166/196, 118, 119, 187, 123, 136

[56] References Cited

U.S. PATENT DOCUMENTS

| | | | |
|---|---|---|---|
| 4,388,971 | 6/1983 | Peterson | 166/387 |
| 4,572,290 | 2/1986 | Clifton . | |
| 4,862,957 | 9/1989 | Scranton . | |
| 5,141,053 | 8/1992 | Restarick et al. | 166/120 |
| 5,143,015 | 9/1992 | Lubitz et al. | 166/187 |
| 5,226,494 | 7/1993 | Rubbo et al. | 166/250.17 |
| 5,311,938 | 5/1994 | Hendrickson et al. | 166/134 |
| 5,311,939 | 5/1994 | Pringle et al. . | |
| 5,343,963 | 9/1994 | Bouldin et al. | 166/65.1 X |
| 5,433,269 | 7/1995 | Hendrickson | 166/134 |

*Primary Examiner*—Frank Tsay
*Attorney, Agent, or Firm*—Rosenblatt & Redano P.C.

[57] ABSTRACT

A dog sub is provided for use in an assembly for running liners with a weight-set packer. The dog sub allows rotation of the work string in an effort to set down weight on the dogs. The dogs are allowed to move radially outwardly by a pick-up force from the surface whereupon a set-down force, the dogs engage the setting sleeve on the weight-set packer. The dog sub is provided with a shear pin or other mechanism that breaks at about the requisite set force necessary to set the weight-set packer. When the assembly is retrieved to the surface, the breakage of the shear mechanism within the dog sub indicates to the surface personnel that an appropriate amount of set-down force has been applied to the weight-set packer below. Each of the dogs has an insert which rides on the polished surface of the packer setting sleeve to protect it as the dog sub is raised to allow the dogs to expand for setting the packer.

14 Claims, 1 Drawing Sheet

INDICATING DOG SUB FOR WEIGHT-SET PACKERS

FIELD OF THE INVENTION

The field of this invention relates to techniques for setting packers using set-down weight by advancement of a work string, particularly in the area of deviated wellbores.

BACKGROUND OF THE INVENTION

Weight-set packers are commonly used with liner strings to seal between the liner and the casing. Typically, the assembly is made up at the surface and run into position, at which point a liner hanger is set against the casing in the wellbore. The weight-set packer is then supported off of the liner secured to the casing by the liner hanger. Typically, the assembly above the packer is then picked up from the surface to release the running tool from the packer. Upon sufficient upward movement, the dogs in a dog sub would be allowed to extend such that upon a subsequent setting down of weight, the dogs would engage the setting sleeve for the packer so that it could be set.

In cases of highly deviated wellbores, there was no reliable way to know whether the set-down weight applied at the surface was fully transmitted to the setting sleeve on the weight-set packer so as to know if it had been subjected to the requisite setting force to obtain the necessary seal between the casing and the liner.

To address this need, the present invention has, as its objective, to allow feedback to surface personnel that the requisite amount of set-down force has been applied to the packer. Another objective of the invention is to protect the polished seal bore from being marred by the dogs during times of relative movement before the dogs are allowed to move radially outwardly. Another objective is to allow the weight to be applied to the weight-set packer by permitting rotation of the work string while applying set-down weight.

U.S. Pat. Nos. 4,572,290, 4,862,957; and 5,311,939 show generally the mechanisms used for actuation of mechanically set packers.

Those and other features of the invention will be described below in a discussion of the preferred embodiment.

SUMMARY OF THE INVENTION

A dog sub is provided for use in an assembly for running liners with a weight-set packer. The dog sub allows rotation of the work string in an effort to set down weight on the dogs. The dogs are allowed to move radially outwardly by a pick-up force from the surface whereupon a set-down force, the dogs engage the setting sleeve on the weight-set packer. The dog sub is provided with a shear pin or other mechanism that breaks at about the requisite set force necessary to set the weight-set packer. When the assembly is retrieved to the surface, the breakage of the shear mechanism within the dog sub indicates to the surface personnel that an appropriate amount of set-down force has been applied to the weight-set packer below. Each of the dogs has an insert which rides on the polished surface of the packer setting sleeve to protect it as the dog sub is raised to allow the dogs to expand for setting the packer.

DETAILED DESCRIPTION OF THE PREFERRED EMBODIMENT

Figure 1:
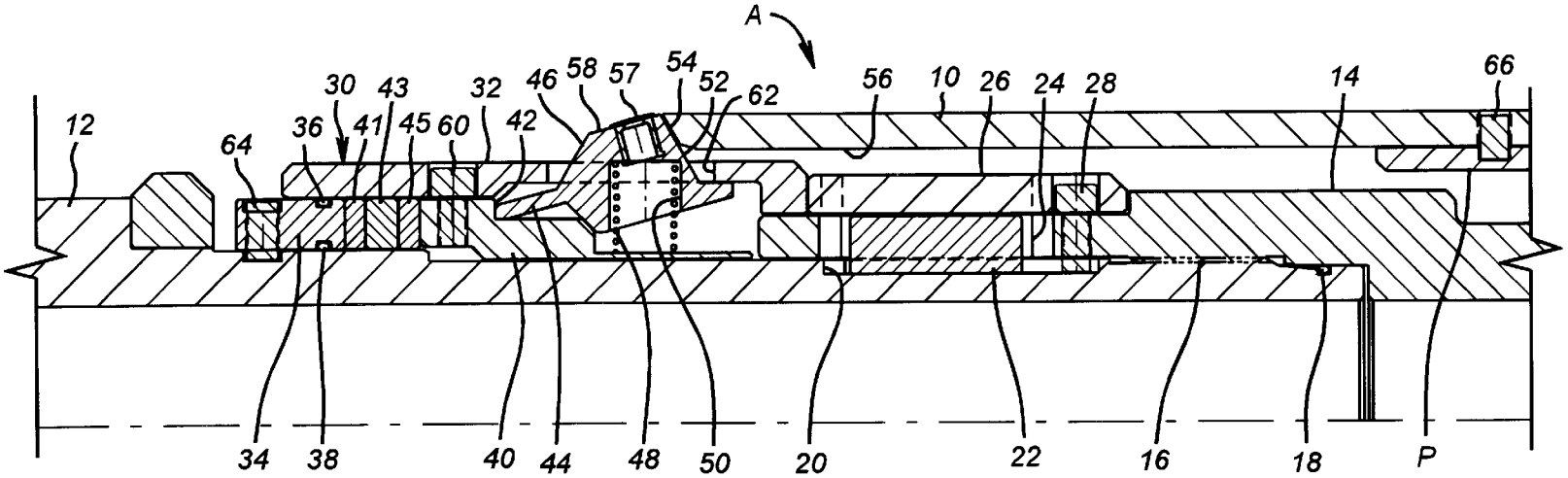
FIG. 1 is a sectional elevational view showing the dog sub with the dogs extended, ready to apply set-down weight to the packer setting sleeve, with shear pins intact.

The apparatus A is shown in FIG. 1. A packer setting sleeve 10 is illustrated. For clarity, the liner, liner hanger, and the casing are omitted so that the drawings can more readily focus on the portion of the assembly which is the preferred embodiment of the invention. A portion of the packer P is shown schematically. The work string extending from the surface to the area of the setting sleeve 10 is generally identified as 12. The work string 12 is secured to the running tool 14 at thread 16, and the threaded connection is sealed by O-ring 18. The lower end of the work string 12 has a recess 20. Lug 22 extends into recess 20, and at the same time into an opening 24 in running tool 14 so as to prevent relative rotation between the running tool 14 and the work string 12. The lug 22 is retained by cover 26, which is secured by bolt or bolts 28.

The dog sub 30 comprises an outer sleeve 32, which fits over an inner sleeve 34. O-rings 36 and 38 seal, respectively, between inner sleeve 34 and outer sleeve 32, and inner sleeve 34 and the lower end of the work string 12. A bearing comprising a plurality of stacked rings 41, 43, and 45 packed in grease extends between inner sleeve 34 and dog support 40 to facilitate relative rotation between the two and also to transmit downward loads applied through the work string 12 through inner sleeve 34 which is pinned to work string 12 by shear pin 64.

Dog support 40 has a shoulder 42 which bears on tab 44 extending from dog 46. Dog 46, of which there may be one or a plurality, is spring-biased by spring 48, which bears on dog support 40 and extends into a recess 50 in dog 46. Each dog 46 has a bearing surface 52 which, when extended as shown in FIG. 1, is designed to engage the upper end 54 of the setting sleeve 10. The setting sleeve 10 has an internal polished bore 56. When the dogs 46 are retracted substantially within outer sleeve 32 during run-in, the insert 57 in outer surface 58 of dogs 46 rides along the polished bore 56. Since the insert 57 is softer than the polished bore 56 due to its preferred construction from a plastic material, the polished bore 56 is protected as the dogs 46 ride along it until the dogs 46 can emerge when they are brought up above the upper end 54 of the setting sleeve 10.

It can readily be seen that the dog support 40, which is secured to the outer sleeve 32 by bolt or bolts 60, including the dogs 46 extending through openings 62 in outer sleeve 32, are an assembly which can remain relatively stationary in the face of a rotational force applied to the work string 12. When the work string 12 is rotated, inner sleeve 34 is secured to the work string 12 by indicating shear pin 64. Due to the presence of lug 22 in opening 24 and the thread connection 16, the work string 12 rotates with the running tool 14 and the cover 26. Thus, when setting down weight from the surface on the work string 12, it can also be rotated without driving the dogs 46 along the upper end 54 of the setting sleeve 10. If this happened it could cause damage to the dogs 46, as well as the setting sleeve 10 and/or the polished bore 56 within the setting sleeve 10. The ability to rotate the work string 12 while setting down weight also helps in deviated wellbores to advance it sufficiently to further ensure that the appropriate set-down weight is applied to the setting sleeve 10 so that the packer is fully operational.

The setting sleeve 10 is initially held in position by a shear pin 66. Shear pin 66 typically prevents the setting sleeve 10 from actuating the packer until an accumulated set-down force of approximately 50,000 lbs. is applied to the setting sleeve 10. Other force values can be used without departing from the spirit of the invention. A portion of the packer P which retains the shear pin 66 is schematically illustrated in FIG. 1.

Figure 2:
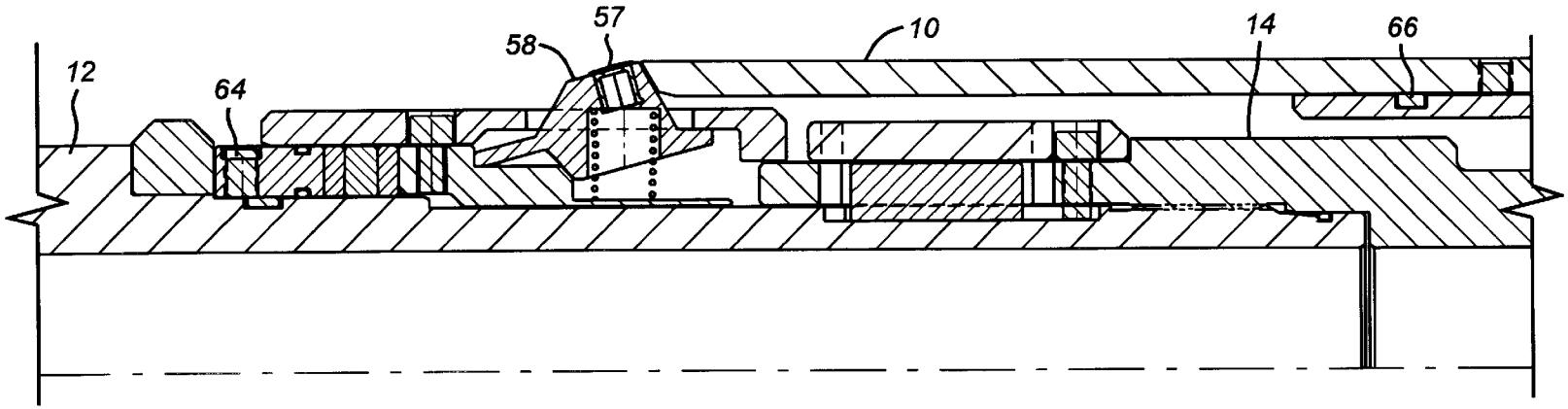
FIG. 2 is the view of FIG. 1 after the set-down weight has been applied, showing the shear pin for the setting sleeve broken, as well as the indicating shear pin, which acts as a signal to surface personnel as to the amount of set-down force applied to the packer, in the broken condition.

Comparing FIGS. 1 and 2, it can be seen that after a predetermined set-down force has been applied to the setting sleeve 10, the shear pin 66 is broken in pieces as the packer P sets. The applied force through the dogs 46 goes through dog support 40 to inner sleeve 34, and finally through shear pin 64. The indicating shear pin 64 is set for approximately the same shear force as the shear pin 66, or somewhat more. Accordingly, when the assembly is retrieved to the surface and shear pin 64 is broken, that is the signal to the surface personnel that the requisite set-down force has been applied to the setting sleeve 10 in that shear pin 66 has preferably the same rating as shear pin 64. Thus, if shear pin 64 is shown broken, it can be concluded that a sufficient force to also break shear pin 66 has been applied and the packer P is set with the requisite force applied to the setting sleeve 10.

The bearing feature illustrated as rings 41, 43, and 45 allow the work string 12 to be rotated without turning the dogs 46 so that damage is prevented from occurring to the setting sleeve 10.

As a result of the apparatus A of the present invention, a simple and effective signal is provided, which is particularly helpful in deviated wellbores where there is no certainty that the applied weight at the surface is directly translated to the setting sleeve 10 of the weight-set packer P in the deviated wellbore. That feature is enhanced by the insert 57 which protects the polished bore 56 inside the setting sleeve 10.

The foregoing disclosure and description of the invention are illustrative and explanatory thereof, and various changes in the size, shape and materials, as well as in the details of the illustrated construction, may be made without departing from the spirit of the invention.

We claim:

1. A dog sub for use in a work string to set a packer, comprising:

a body;

at least one dog mounted to said body, selectively movable into contact with a portion of the packer for setting the packer with an applied force;

a signal mechanism in said body, movable to an indicating position responsively to an applied force exceeding a predetermined amount applied to said body.

2. The dog sub of claim 1, further comprising:

an insert on said dog which is softer than the portion of the packer which is contacted by said insert while said dog is retained by the packer in a retracted position.

3. The dog sub of claim 2, wherein:

said body has a bearing between an upper and lower component, said dog supported on said lower component so that a rotational force applied to said upper component will not cause meaningful rotation of said dog.

4. The dog sub of claim 1, wherein:

said body has a bearing between an upper and lower component, said dog supported on said lower component so that a rotational force applied to said upper component will not cause meaningful rotation of said dog.

5. The dog sub of claim 3, wherein:

said bearing comprises of at least one ring packed in grease.

6. The dog sub of claim 4, wherein:

said bearing comprises of at least one ring packed in grease.

7. The dog sub of claim 1, wherein:

said signal mechanism comprises a load-transferring member secured to said body by a breakable member;

said load-transferring member directing loads applied to said body to said dog up to a predetermined force, which results in failure of said breakable member.

8. The dog sub of claim 7, wherein:

said breakable member comprises at least one shear pin.

9. The dog sub of claim 7, wherein:

said breakable member is designed to fail in a load range substantially at or above a load level at which the packer is designed for setting.

10. The dog sub of claim 8, wherein:

said breakable member is designed to fail in a load range substantially at or above a load level at which the packer is designed for setting.

11. The dog sub of claim 10, wherein:

said body has a bearing between an upper and lower component, said dog supported on said lower component so that a rotational force applied to said upper component will not cause meaningful rotation of said dog.

12. The dog sub of claim 11, wherein:

said bearing comprises of at least one ring packed in grease.

13. The dog sub of claim 12, wherein:

said load-transferring member bears on said bearing in order to transmit a force from said body to said dog.

14. The dog sub of claim 13, wherein:

said bearing comprises a plurality of grease-packed rings;

said dog is spring-loaded to move outwardly when said body is moved so as to remove said dog from within the packer.

* * * * *